11/8/83 XR SR 4,413,718

United States Patent [19]

Dean

[11] 4,413,718

[45] Nov. 8, 1983

[54] METHOD AND APPARATUS FOR DETECTING THE PRESENCE OF A COIN IN A PASSAGEWAY

[75] Inventor: Robert Dean, Slough, England

[73] Assignee: Mars, Inc., McLean, Va.

[21] Appl. No.: 212,714

[22] PCT Filed: Mar. 26, 1980

[86] PCT No.: PCT/GB80/00054

§ 371 Date: Nov. 26, 1980

§ 102(e) Date: Oct. 29, 1980

[87] PCT Pub. No.: WO80/02081

PCT Pub. Date: Oct. 2, 1980

[30] Foreign Application Priority Data

Mar. 26, 1979 [GB] United Kingdom ..... 7910550

[51] Int. Cl.[3] ..... G07D 9/00

[52] U.S. Cl. ..... 194/1 K; 350/287

[58] Field of Search ..... 194/1 K, 97 A, 99, 100 A, 194/102; 350/287; 250/239

[56] References Cited

U.S. PATENT DOCUMENTS

| | | | |
|---|---|---|---|
| 2,237,132 | 4/1941 | Christensen | 194/1 K |
| 3,041,461 | 6/1962 | Lindemann et al. | 250/239 X |
| 3,860,329 | 1/1975 | Baker et al. | 350/287 |
| 3,901,607 | 8/1975 | Kingsland . | |
| 3,998,309 | 12/1976 | Mandas et al. | 194/97 R |
| 4,082,099 | 4/1978 | Iwersen | 133/3 R |
| 4,089,400 | 5/1978 | Gregory | 194/97 A |
| 4,106,610 | 8/1978 | Heiman | 194/97 R |

FOREIGN PATENT DOCUMENTS

| | | |
|---|---|---|
| 2724869 | 12/1978 | Fed. Rep. of Germany . |
| 1278363 | 6/1972 | United Kingdom . |
| 1465579 | 2/1977 | United Kingdom . |
| 1502250 | 2/1978 | United Kingdom . |
| 2013332 | 8/1979 | United Kingdom . |

*Primary Examiner*—F. J. Bartuska

*Attorney, Agent, or Firm*—Davis, Hoxie, Faithfull & Hapgood

[57] ABSTRACT

The invention concerns apparatus and a method for detecting the presence of a coin in a coin passageway (14; 64, 66 and 68). The apparatus comprises a light source (25; 84) for directing a beam of light across the passageway at a first location and a light detector (26; 86) for detecting a beam of light crossing the passageway, at a second location, both located in one wall of the passageway. A prism (29; 94) of transparent material is located in a wall of the passageway opposite the light source and light detector and has two 45° reflecting surfaces (32 and 33; 100 and 102). The first reflecting surface (32; 100) reflects a beam of light from the light source (25; 84) towards the second reflecting surface (33; 102) and the second reflecting surface (33; 102) reflects the beam of light toward the light detector (26; 86). Thus the beam of light from the source (25; 84) to the sensor (26; 86) crosses the passageway at two positions spaced from one another. The method comprises the steps of directing a beam of light across a passageway in the intended path of a coin at a first location, reflecting the beam back across the passageway in the intended path of a coin at a second location and detecting the failure of the reflected beam to cross the passageway.

14 Claims, 7 Drawing Figures

METHOD AND APPARATUS FOR DETECTING THE PRESENCE OF A COIN IN A PASSAGEWAY

The present invention relates to an apparatus and a method for detecting the presence of objects and is especially concerned with detecting the presence of a coin in a vertical or near vertical coin passageway.

In coin-operated machines it is sometimes necessary to detect the presence of a coin in a vertical or near vertical coin passageway. For example, in a coin testing device it may be necessary to detect the presence of a coin that has been inserted into and is falling down a vertical entry passageway in order to provide a single which sets the coin testing circuitry in readiness for the arrival of the coin at a coin testing station. It is also sometimes necessary to detect when a coin which has been tested and found to be acceptable has passed an entry gate leading to a coin acceptance passageway in order that the gate may then be closed and the acceptance signal may be passed to a totaliser which accumulates the values of coins accepted.

One known arrangement for detecting the passage of a coin along a coin passageway consists of a light source in one wall of the coin passageway and a light detector on the opposite wall positioned so that a beam of light from the source normally crosses the passageway and falls on the light sensor. The passage of a coin causes temporary interruption of the beam of light and thus is detected by a temporary change in the output of the sensor.

For the coin machine manufacturer making mechanisms for testing different sets of coins to meet the requirements of customers throughout the world, it is desirable, so far as possible, to use one size of part for all coin sets. Coins vary considerably in size. For example, the Dutch 10 cents coin has a diameter of 15 mm. whereas the Danish 5 Krone has a diameter of 33 mm. Therefore in a mechanism which is designed for universal application the coin passageways must be large enough to allow the 33 mm. Danish 5 Krone coin to pass with clearance. However, detecting the passage of a 15 mm. Dutch 10 cent coin dowwn a vertical passageway which is large enought to pass the 5 Krone coin using the known arrangement of light source and sensor is unreliable because the coin can pass by the side of the light beam without interrupting the light beam and thus be undetected.

The present invention can be used to detect the presence of the coin in a coin passageway and thus overcome this problem.

According to the present invention in a first embodiment there is provided apparatus for detecting the presence of coins comprising a passageway along which the coins can pass, the passageway having an oblong cross section and being defined by two generally parallel closely-spaced walls, a light source and a light detector being located in or adjacent one of the walls of the passageway, the light source and light detector being spaced from one another across the width of the passageway and from the sides of the passageway, first and second reflecting means being located in or adjacent the other said wall of the passageway opposite the light source and light detector, respectively, so that the first reflecting means reflects a light beam crossing the passageway from the light source towards the second reflecting means and the second reflecting means reflects the beam reflected by the first reflecting means across the coin passageway towards the light detector, the spacing of the beams crossing the passageway from each other and from the sides of the passageway all being less than the size of the smallest object which the apparatus is intended to detect.

The present invention can also be used to detect the presence of a jammed coin in a coin storage tube. In a second embodiment apparatus according to the present invention comprises a light source and a light detector located in or adjacent a first circumferential location of the round coin tube. First and second reflecting means are located in or adjacent a second circumferential location of the coin tube diametrically opposed to the first circumferential location. The light source and light detector are at the same axial location of the tube as the first and second reflecting means, respectively.

The term "light source" is intended to include infrared light sources and ultra violet light sources. Conveniently the light source may comprise a light-emitting diode and the light detector may comprise a photo-transistor.

The apparatus according to the invention has the further advantage that because the light source and detector are on the same side of the coin passageway, electrical connections to the light source and light detector are from one side only. This facilitates the design and construction of machines incorporating the apparatus according to the invention.

The reflecting means according to the invention may be provided by a prism of transparent material, the first and second reflecting means comprising first and second surfaces of the prism arranged at approximately 45° to the wall of the coin passageway, the beam being reflected by total internal reflector in the prism.

According to the present invention there is also provided a method of detecting the presence of a coin in a passageway comprising directing a light beam across the intended path of the coin at a first location of the passageway at a first location, reflecting the beam back across the intended path of the coin at a second location of the passageway, and sensing when the reflected light beam fails to cross the passageway.

Two embodiments of the invention will now be described by way of example with reference to the accompanying drawings of which:

Figure 1:
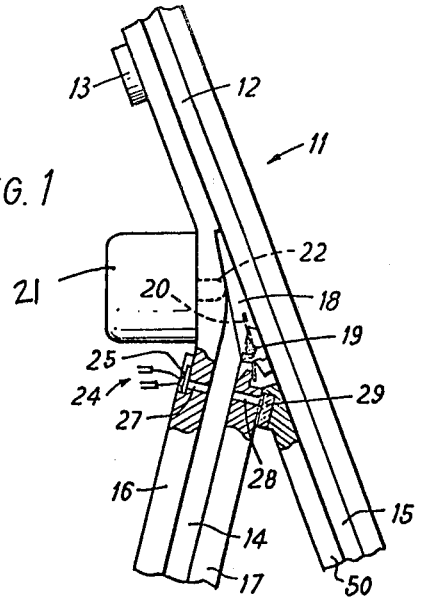
FIG. 1 shows a side elevation, partly in section, of part of a coin testing mechanism incorporating a first embodiment of the present invention.
Figure 2:
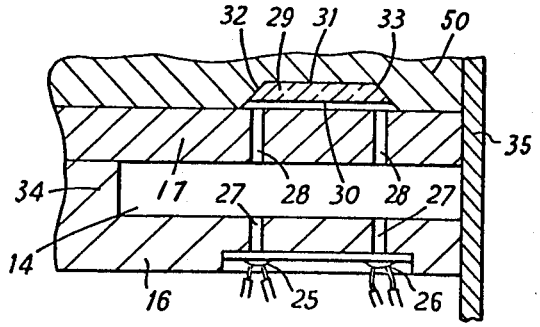
FIG. 2 shows a fragmentary horizontal section of the part of the mechanism shown in FIG. 1.
Figure 3:
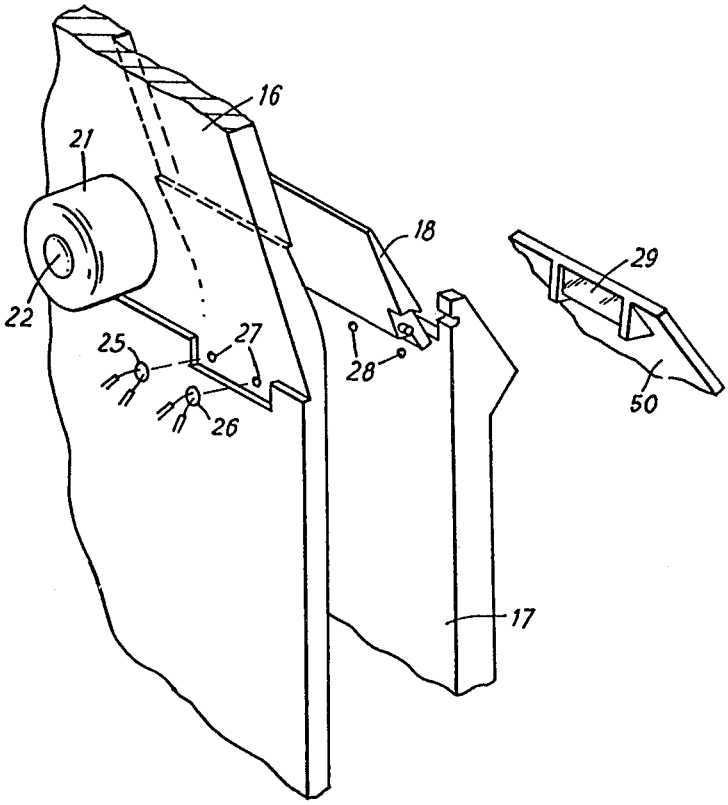
FIG. 3 shows a diagrammatic exploded perspective view of the apparatus of FIGS. 1 and 2.

Referring to the drawings, these show part of a coin testing mechanism 11 which includes a passageway 12 where coins inserted into the mechanism are tested for authenticity and denomination by electronic circuitry with sensors 13 located adjacent the passageway 12.

The coin testing circuitry and sensor may be of any suitable design; for example, they may be as described in our British Pat. No. 1,397,083.

Below the passageway 12 are an acceptance passageway 14 and a reject passageway 15. The passageways are nearly vertical and have an oblong horizontal cross section. The walls of the passageway 14 are provided by two closely spaced moulded plastic plates 16 and 17.

Figure 4:
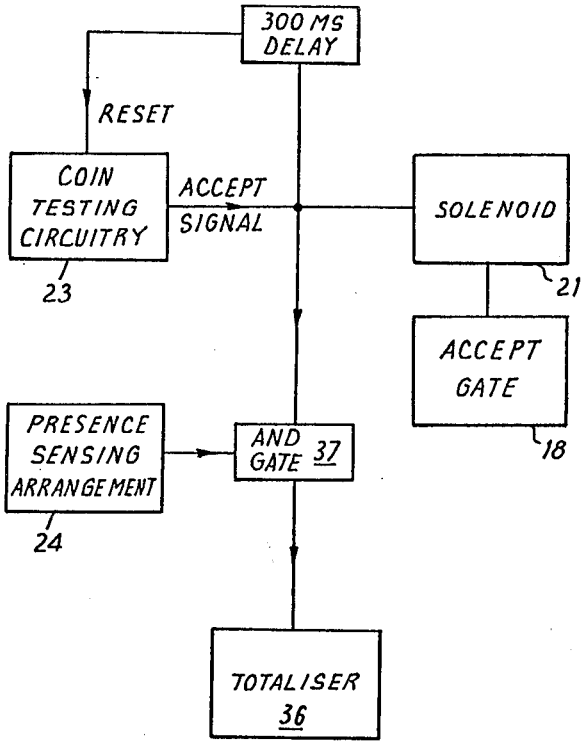
FIG. 4 shows a block circuit diagram showing how the signal from the sensor of FIGS. 1 and 3 may be used.

The entrance to the acceptance passageway is normally closed by gate 18 which can pivot about a horizontal axis 19 but which is biased into the closed position by means of a leaf spring 20 which is secured to the plate 17 and bears against the gate 18. The gate 18 can be opened by energising a solenoid 21 which has an armature 22 which passes through a hole in the plate 16 and bears against the gate 18 at a point above the hinge axis. As indicated in FIG. 4 when the test circuitry 23 determines that a coin inserted into the mechanism is acceptable it causes the solenoid 21 to be energised to open the entrance to the acceptance channel.

To provide a signal to indicate that the coin has arrived in the acceptance passageway a coin presence sensing arrangement 24 is provided.

The sensing arrangement 24 comprises an infra-red emitting diode 25 and a photo diode 26 mounted in two horizontally spaced holes 27 in the plate 16. In the plate 17 are two holes 28 aligned with the holes 27 and behind these holes is a prism 29. The prism 29 is mounted on a plate 50 of moulded plastic material which also serves to form one wall of the reject passageway. The plate 50 is mounted against the plate 17 with the prism positioned over the holes 28.

The prism 29 is made of clear acrylic plastics material and has flat front and rear faces 30 and 31 which are disposed perpendicular to the axis of the holes 27 and 28. The end faces 32 and 33 are inclined at 45° to the axes of the holes 27 and 28 and the normals to the end faces lie in a common plane with the axes of the holes. The inclined end faces of the prism are opposite the end of the holes 28.

The infra-red emitting diode 25 is connected to a suitable supply of electricity (not shown) so as to act as a light source. The light from the diode 25 is collimated by the hole 27 so that a beam of light crosses the passageway 14, passes through the corresponding hole 28 and enters the prism 29 passing perpendicularly through its front surface 30. At the inclined end surface 32 the light beam undergoes total internal reflection through 90° and passes parallel to the wall of the passageway, inside the prism towards the end surface 33. At the surface 33 the light beam undergoes total internal reflection through 90° to emerge from the prism perpendicularly to the front face and parallel to the part of the beam entering the prism. The emergent beam passes through the corresponding hole 28, crosses the coin passageway and enters the hole 27 to fall on the photo-transistor 26. The photo-transistor is connected in an electrical circuit (not shown), the output of which is amplified and used to provide a signal for indicating the presence of a coin in the acceptance passageway.

The sides of the coin passageway 14 adjacent the sensing arrangement are formed by a vertical moulded strip 34 on the plate 16 and a metal plate 35 of the housing for the coin mechanism. The width of the coin passageway 14 between the strip 34 and the plate 35 is about 40 mm. to allow a Danish 5 Krone coin to be accepted and pass with clearance down the acceptance passageway. The spacings between the strip 34 and the light source 25, the light source and the light detector 26 and the light detector and the plate 35 are all about 13.5 mm. Thus when a coin as small as the Dutch 10 cents coin passes down the passageway the light beam between the light source and the detector will be interrupted at at least one of the two positions where it crosses the passageway. In this way the sensing arrangement detects coins which might not be detected by a centrally arranged sensor and light source on opposite sides of the passageway.

The interruption of the light falling on the photo-transistor 26 causes a change in output from its circuit which serves as a signal to indicate the presence of a coin in the acceptance passageway 14.

FIG. 4 illustrates in a simplified form how this signal can be used. As has been mentioned above a signal from the coin testing circuitry 23 indicative of an acceptable coin is used to cause the solenoid 21 to be energised, thus opening the accept gate 18. The sensing arrangement 24 detects the presence of the coin when it has entered the acceptance passageway 14. The signal from the sensing arrangement 24 is combined in the AND gate 37 with the accept signal from the testing circuitry and passed to the totaliser 36 so as to initiate the accumulation in the totaliser 36 of the value of the coin accepted and to cancel the "accept" signal, thereby causing the gate 18 to close. If no accept signal is received after a delay of about 300 milliseconds the accept signal is cancelled and no value is credited in the totaliser 36.

Figure 5:
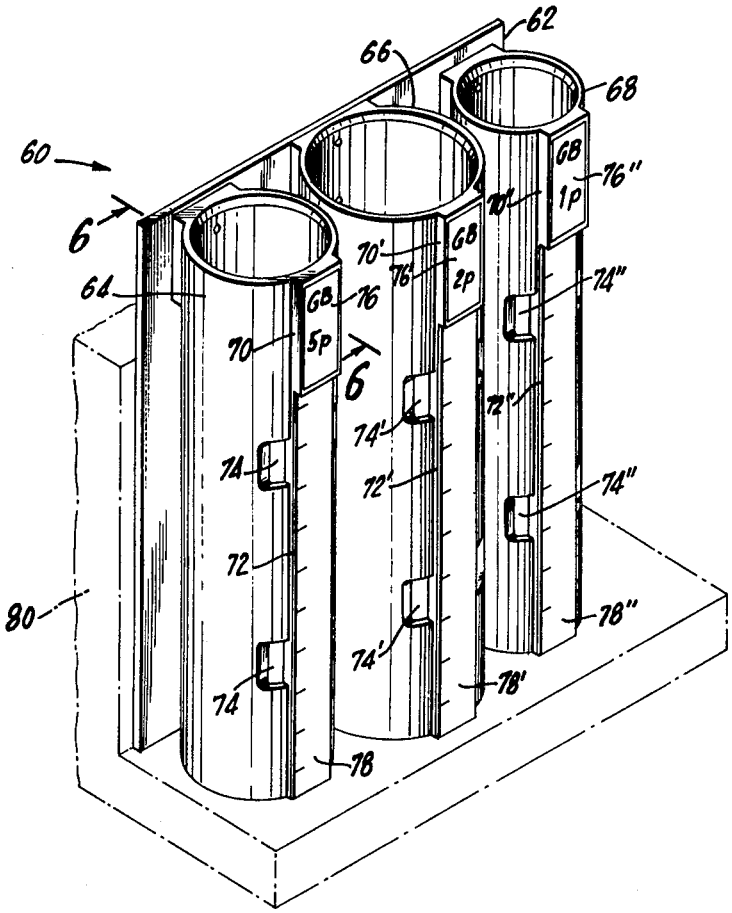
FIG. 5 is a schematic pictorial representation of a coin receptacle incorporating the second embodiment of the detecting apparatus of the present invention.
Figure 6:
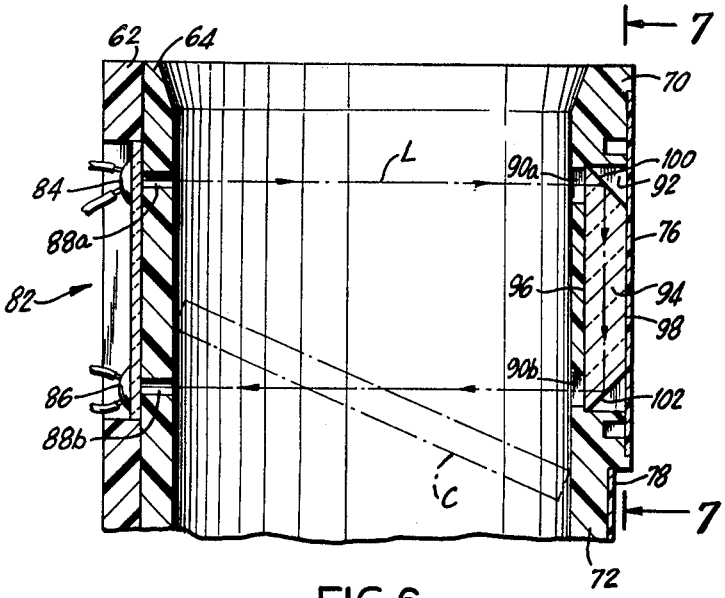
FIG. 6 is a sectional view taken along 6—6 of FIG. 5 to show the use of the embodiment of FIG. 5.
Figure 7:
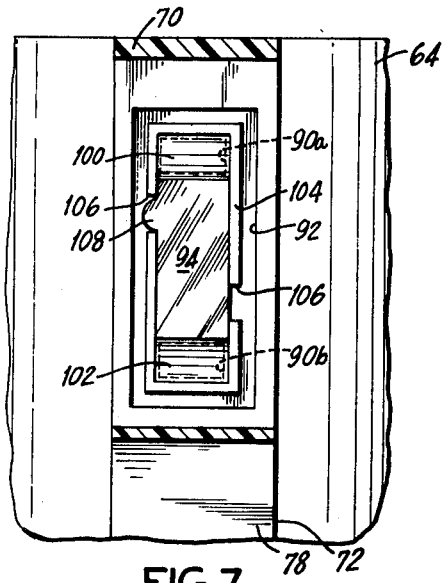
FIG. 7 is a sectional view taken along 7—7 of FIG. 6 to show a positioning feature that insures proper orientation of the prism used in the apparatus of the present invention.

This invention can also be used to detect a jammed coin in a receptacle or coin tube of a coin mechanism. FIGS. 5, 6 and 7 show an embodiment appropriate for this application.

FIG. 5 schematically shows a coin receptacle 60. The receptacle comprises a mounting means 62 to which three coin tubes 64, 66 and 68 are secured. Coin tube 64 is generally circular in cross-section and has a diameter slightly larger than a British five pence coin. Coin tube 64 includes a raised mounting pad 70 and a flat surface 72 that extends the length of the coin tube 64. The coin tube 64 also includes windows 74 to allow a view of the coins accumulated within the tube.

The mounting pad 70 carries a removable plastic label 76 that identifies the coin that the tube 64 will accept. The flat surface 72 carries a similar label 78 with ruled markings that enable determination of the number of coins in the tube 64 by sighting them through the window 74 and reading the adjacent indicia on the label 78.

The coin tube 66 is also generally circular in cross-section and has a diameter slightly larger than a British two pence coin. The coin tube 66 includes a raised mounting pad 70', a raised flat surface 72', windows 74' and plastic labels 76' and 78', all performing the same functions as their counterparts associated with the coin tube 64. The coin tube 68 is also circular in cross-section and has a diameter slightly larger than a British one pence coin. The coin tube 68 includes a raised mounting pad 70'', a raised flat surface 72'', windows 74'' and plastic labels 76'' and 78'', all performing the same functions as their counterparts associated with the coin tubes 64 and 66. The arrangement and number of coin tubes carried by the mounting means are matters of choice that do not affect the present invention. For example, in one application it has been found advantageous to have a five pence tube at the location shown for coin tube 64, then a one pence tube and then a two pence tube.

The entire mounting means 62 and the coin tubes can be integrally molded from plastic or can be made separately and assembled. The mounting means 62 is secured to a machine part 80 that contains conventional circuitry and associated equipment for detecting jammed coins and for passing coins that are not jammed to other parts of the machine.

FIG. 6 shows in detail how the sensing arrangement of the present invention is installed in the coin tube 64. An infra-red emitting diode 84 and a photo diode 86 are mounted in holes 88*a* and 88*b*, respectively, in the wall of the coin tube 64. At a second location in the wall of the coin tube 64, there are two more holes 90*a* and 90*b* diametrically opposed to the holes 88*a* and 88*b*, respectively. Behind the holes 90, in a recess 92 in the mounting pad 70, is a prism 94. The plastic label 76 keeps the prism 94 in position in the recess 92.

As in the previously described embodiment of the invention, the prism 94 is made of clear acrylic plastic material and has flat front and rear faces 96 and 98 disposed perpendicular to the axes of holes 88 and 90. The end face 100 of the prism 94 is inclined 45° to the axes of the holes 88*a* and 90*a* and the end face 102 of the prism 94 is inclined 45° to the axes of the holes 88*b* and 90*b*. Lines normal to each end face 100 and 102 and the axes of the holes 88 and 90 all lie in a common plane. The inclined end faces 100 and 102 of the prism 94 are opposite the ends of holes 90*a* and 90*b*, respectively. Thus, the diodes 84 and 86, the holes 88 and 90 and the prism 94 are located relative to each other in the same way as are the diodes 25 and 26, the holes 27 and 28 and the prism 31 of the previously described embodiment of the invention.

FIG. 7 shows the inside of the recess 92 and illustrates a positioning feature that insures correct orientation of the prism 94 within the recess 92. The positioning feature comprises a partition 104 that circumscribes the prism 94 except for two small cutouts 106 along its longer edges. The prism 94 includes a small protrusion 108 along one of its longer sides. The protrusion 108 cooperates with the cutouts 106 to insure that the end faces 100 and 102 are properly oriented. With this positioning feature, it is impossible for the prism 94 to be incorrectly oriented within the recess 92 and render the detection system inoperable. Those skilled in the art will appreciate that this positioning feature can also be used in the previously described embodiment of the invention.

In operation, the infra-red emitting diode 84 is connected to a suitable supply of electricity, which is not shown but which will typically be connected to the diode 84 through circuitry included within machine part 80. The light from the diode 84 is collimated by the hole 88*a* so that a beam of light L traverses the coin tube 64 and passes through the hole 90*a*. The beam of light L passes through the hole 90*a* and is reflected by the end faces 100 and 102 of the prism 94. When the beam of light L leaves the prism 94 it passes through hole 90*b*, traverses the coin tube 64 again, enters the hole 88*b* and falls on the photo diode 86. The photo diode 86 is connected to electrical circuitry, again not shown but typically included as part of the machine part 80, that provides an electrical signal that indicates the absence of an obstruction in the coin tube 64.

The presence of a jammed coin C in the upper part of coin tube 64 will be detected when the coin C interrupts the light beam L. The electrical circuitry associated with the detection arrangement 82 includes suitable delay circuitry to distinguish the permanent interruption of the light beam L caused by a jammed coin from the temporary interruption caused by a coin that is properly falling through the coin tube 64. Upon permanent disruption of the light beam L, the electrical circuitry activates a signal that denotes an obstruction in the coin tube 64.

Coin tubes 66 and 68 include the same type of detection arrangements as detection arrangement 82 of the coin tube 64.

I claim:

1. Apparatus for use in coin mechanisms for detecting the passage through a predetermined plane substantially transverse to the coin path of a coin which moves freely through a nearly vertical coin passageway comprising a light source located on a first side of the coin passageway for emitting a beam of light which in the absence of a coin passing through the predetermined plane crosses the coin passageway, in a first line in the predetermined plane, a first reflecting means located across the coin passageway from the light source on a second side of the coin passageway, a second reflecting means also located on the second side of the coin passageway, a light detector located on the first side of the coin passageway across the coin passageway from the second reflecting means, the first and second reflecting means positioned so that in the absence of a coin passing through the predetermined plane the beam of light from the light source crosses the coin passageway, is reflected by the first reflecting means to the second reflecting means, and is reflected by the second reflecting means back across the coin passageway in a second line in the predetermined plane to the light detector, and means for detecting interruption of the beam of light, the light source, the light detector and the first and second reflecting means all being located so that the distances between the first and the second line and between each line and the side of the passageway closest to it are all less than the diameter of the smallest coin that the apparatus is designed to accept whereby the apparatus is suitable for detecting the passage of the smallest acceptable coin regardless of the path taken by it in its movement through the coin passageway.

2. Apparatus according to claim 1 wherein the first reflecting means comprises a first surface of a prism arranged at 45° to the wall of the passageway, and the second reflecting means comprises a second surface of the prism arranged at 45° to the wall of the passageway, so that the light beam is reflected by total internal reflection in the prism.

3. The apparatus recited in claim 2 wherein the prism is located in a recess provided in the wall of said passageway, the recess including a means for positioning the prism that comprises a partition that circumscribes the prism except for two cutouts that cooperate with a protrusion on the side of said prism to insure proper orientation of the prism and the first and second reflecting means relative to the passageway.

4. The apparatus of claim 1 further comprising one or more holes in the two closely spaced walls used to collimate light from the light source.

5. Apparatus for use in coin mechanisms for detecting the presence of a coin jammed in a predetermined region of a coin passageway consisting of a coin tube having a round cross-section, wherein the apparatus comprises a light source for emitting a beam of light and a light detector both of which are located in or adjacent a first circumferential location of the coin tube and spaced from each other along the length of the coin tube, a first and second reflecting means located at the same axial location of the coin tube as the light source and the light detector, respectively, the first and second reflecting means positioned so that in the absence of a coin in the predetermined region of the coin tube the beam of light from the light source crosses the coin tube in a first line, is reflected by the first reflecting means to the second reflecting means, and is reflected by the second reflecting means back across the coin tube to the light detector in a second line, the first and second lines defining a plane transverse to a coin jammed in the predetermined region of the coin tube, and means for detecting interruption of the beam of light.

6. The apparatus recited in claim 5 wherein the first and second circumferential locations are diametrically opposed.

7. The apparatus recited in claim 5 wherein the first reflecting means comprises a first surface of a prism arranged at 45° to the axis of the coin tube, and the second reflecting means comprises a second surface of the prism arranged at 45° to the axis of the passageway, so that the light beam is reflected by total internal reflection in the prism.

8. The apparatus recited in claim 6 wherein the prism is located in a recess provided in a wall of the coin tube, the recess including a means for positioning the prism that comprises a partition that circumscribes the prism except for two cutouts that cooperate with a protrusion on the side of the prism to insure proper orientation of the prism and the first and second reflecting means.

9. The apparatus of any of claim 1, 2, 3, 4, 5, 6, 7, or 8 further comprising a gate means responsive to a gate controlling signal to direct coin travel, wherein the coin passageway branches into first and second passages; the gate means is located at the branching of the coin passageway and directs a coin moving through the coin passageway into either the first or the second coin passage; the light source, the light detector and the first and second reflecting means are all located along the coin passageway at a location after the location of the gate means; and the light detecting means produces the gate controlling signal when the light detector detects an interrupting of the beam of light.

10. A method of detection of a coin in a predetermined plane substantially transverse to the coin path of a coin which moves freely through a nearly vertical coin passageway of a coin mechanism, the method comprising the steps of:

directing a light beam in a first line from a first point in the predetermined plane located on one side of the coin passageway to a second point in the predetermined plane located on the other side of the coin passageway, reflecting the light beam from the second point to a third point in the predetermined plane located on the same side of the coin passageway as the second point, reflecting the light beam in a second line from the third point to a fourth point in the predetermined plane located on the same side of the coin passageway as the first point, and detecting the interruption of the light beam, the first line and the second line being spaced from one another and from the nearest of the sides of the coin passageway by distances which are less than the size of the smallest coin which is to be detected whereby the beam of light is always interrupted by the passage of the smallest coin.

11. The method recited in claim 10 further comprising the step of providing an electrical signal upon detection of the failure of the reflected light beam to cross the passageway.

12. The method recited in claim 10 further comprising the step of providing an electrical signal only upon detection of a failure of the light beam to cross the passageway for a predetermined length of time.

13. The method recited in either claim 11 or 12 further comprising the step of using the electrical signal to control a gate means for directing coins into first and second coin passages.

14. In a coin mechanism operable by means of predetermined different coin denominations having different physical dimensions including a smallest and a relatively much larger largest dimensioned coin and wherein a coin passage of elongate slot-shaped cross-section defined between opposed major side walls and opposed minor end walls is sized to be capable of receiving all of the coins of said different denominations including the largest dimensioned coin thereof in free movement therethrough, the coin passage being oriented so that coins do not simply move therethrough in contact with one of said minor end walls but rather can take different paths differently spaced from the two minor end walls, the improvement comprising detector means for sensing any coin of said predetermined different denominations from the smallest to the largest dimensioned coin and irrespective in the case of the smallest dimensioned coin of the path taken by the coin in its movement through the passage, said detector means comprising a light source, means for causing a beam of light from the source to traverse said passage between said opposed major side walls generally in a plane transverse to the direction of the passage a plurality of times at a respective plurality of locations so spaced apart from one another and from said end walls that the smallest of said predetermined coin denominations in passing through the passage must interrupt said beam at at least one location regardless of the path it takes through the relatively much larger passageway, and a detector responsive to interruption of said beam for indicating the passage of a coin of one of said predetermined denominations through said passage.

* * * * *

UNITED STATES PATENT AND TRADEMARK OFFICE

CERTIFICATE OF CORRECTION

PATENT NO. : 4,413,718

DATED : Nov. 8, 1983

INVENTOR(S) : Robert Dean

It is certified that error appears in the above-identified patent and that said Letters Patent are hereby corrected as shown below:

Col. 1, line 14, "single" should be --signal--.

line 43, "dowwn" should be --down--.

line 44, "enought" should be --enough--.

Signed and Sealed this

*Twentieth* Day of *March 1984*

[SEAL]

*Attest:*

GERALD J. MOSSINGHOFF

*Attesting Officer*

*Commissioner of Patents and Trademarks*